US009023293B2

(12) United States Patent
Seidel

(10) Patent No.: US 9,023,293 B2
(45) Date of Patent: May 5, 2015

(54) DEVICE FOR SEPARATION OF ESSENTIAL OILS AND METHOD OF USE

(71) Applicant: Robert Seidel, Portland, OR (US)

(72) Inventor: Robert Seidel, Portland, OR (US)

( * ) Notice: Subject to any disclaimer, the term of this patent is extended or adjusted under 35 U.S.C. 154(b) by 20 days.

(21) Appl. No.: 13/972,720

(22) Filed: Aug. 21, 2013

(65) Prior Publication Data

US 2014/0058121 A1 Feb. 27, 2014

Related U.S. Application Data

(60) Provisional application No. 61/691,925, filed on Aug. 22, 2012.

(51) Int. Cl.
*B01L 3/08* (2006.01)
*C11B 9/02* (2006.01)

(52) U.S. Cl.
CPC ... *C11B 9/027* (2013.01); *B01L 3/08* (2013.01)

(58) Field of Classification Search
CPC ..... B01L 3/08; B01L 3/508
USPC ..... 422/556, 534; 99/456; D10/46.2; D7/315
See application file for complete search history.

(56) References Cited

U.S. PATENT DOCUMENTS 2,851,404 A * 9/1958 Jackson, Jr. et al. ..... 202/160
6,911,119 B2 * 6/2005 Babu et al. ..... 202/83

OTHER PUBLICATIONS http://www.labdepotinc.com/Product_Details~id~31~pid~59174.aspx, obtained using Wayback Machine from Jun. 28, 2009.*
http://www.gutenberg.org/files/27713/27713-h/27713-h.htm , obtained using Wayback Machine from Mar. 25, 2009.*

* cited by examiner

*Primary Examiner* — Jill Warden
*Assistant Examiner* — Matthew Krcha
(74) *Attorney, Agent, or Firm* — Peter A Haas Esquire LLC

(57) ABSTRACT

A light-oil separator device includes a collector funnel having a downwardly directed stem portion having an outside diameter. The stem portion adapts to insert in an upward extending neck portion of a collection vessel. The neck portion includes an inner diameter that is greater than the outer diameter of the funnel stem. The neck also includes an oil port at a first height. The vessel includes a body having a hydrosol port at a lower portion of a body sidewall. This port connects to an evacuation tube having a proximal end and an S-shape. This conduit includes an air vent at a top portion at a second height lower than the first height, the air vent extends upward to a height higher than the first height. The S-shape conduit terminates with a downward facing end portion at its distal end.

6 Claims, 1 Drawing Sheet

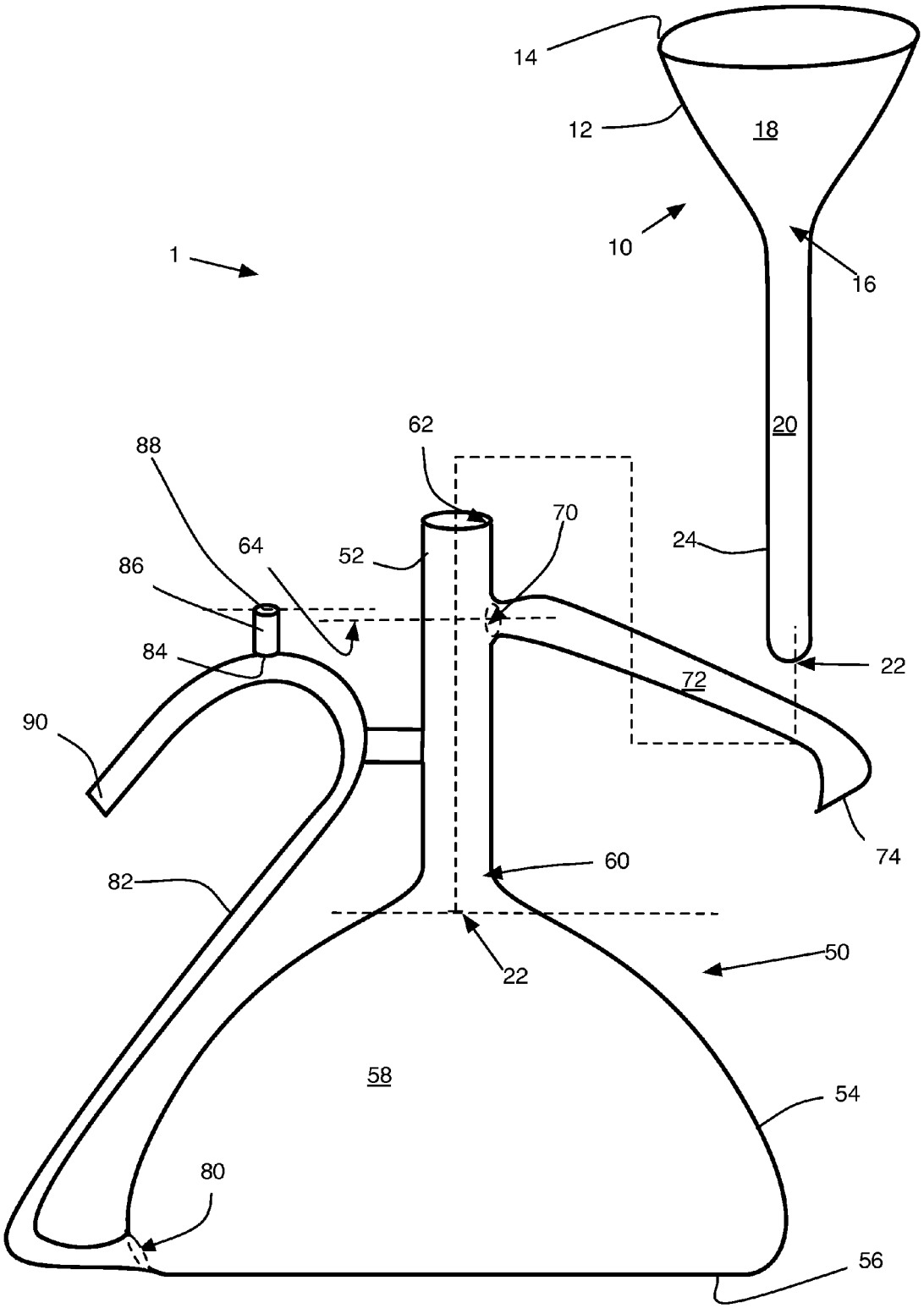
14
12
18
10
1
16
20
62
88
70
64
52
24
86
84
22
72
90
74
60
82
50
22
58
54
80
56

DEVICE FOR SEPARATION OF ESSENTIAL OILS AND METHOD OF USE

PRIORITY CLAIM

The present application claims benefit under 35 U.S.C. Section 119(e) of U.S. Provisional Patent Application Ser. No. 61/691,925 filed on 2012 Aug. 22, titled "Improved Device for Separation of Essential Oils and Method of Use" by a common inventor: The present application is based on, and claims priority from, this application, the disclosure of which is hereby expressly incorporated herein by reference.

BACKGROUND

The present invention relates to a method and improved apparatus for separating a distillate resulting from distillation to produce essential oils. More specifically, the present invention relates to a low-flow separation process including an improved apparatus.

Essential oils are aromatic materials of vegetable origin and are typically used to create perfumes, soaps, lotions, and flavorings. Essential oils occur in many different parts of plants; for example, in the roots (e.g. vetiver), bark (e.g. cinnamon), heartwood (e.g. sandalwood), leaves (e.g. bay), herbs (e.g. peppermint), seeds (e.g. nutmeg), and flowers (e.g. lavender).

The essential oil of a plant consists of many compounds, which generally boil between 150-degrees C. to about 300-degrees C. If attempts are made to remove these compounds by dry distillation many will decompose and the oil will be ruined. However, the compounds are steam volatile and can be distilled out of the vegetal materials at around 100° C. Thus, the majority of essential oils are produced by the process of steam distillation, water/steam distillation, or hydro-distillation.

Preparation of the plant material for distillation varies: Some material must be distilled immediately after harvesting, whereas other is stored for a day or two before distilling, and yet other material can be stored indefinitely before distillation. In general, flowers should be distilled immediately but herbaceous material benefits from wilting for one or two days before distillation. And, woody materials may need to be ground and/or soaked before distillation.

There are three basic types of essential oil distillation: Water (or hydro-distillation) distillation, water and steam (wet steam) distillation, and steam (or dry steam).

The first type, hydro-distillation, immerses the plant material in water (charge) are both boiled. As a result, hydro-distillation uses the simplest type of still and are commonly used by smaller-volume producers of essential oils. One disadvantage of this method and device revolves around the heat source used to boil the suspended plant material in water: The heat is difficult to control, which makes the rate of oil production variable, and more importantly, this technique can lead to local overheating and "burning" of the charge leading to a poorer quality oil.

Another form of hydro-distillation incorporates generating steam from a boiler that is separated from the still. The steam then heats an inner pot containing water and plant material. One disadvantage of this approach is that it requires the heating of a large quantity of water adding cost and time needed for each distillation. This method is generally used for delicate flowers such as rose petals and orange blossoms.

The second type, water/steam distillation, utilizes a still with a grid that suspends the plant material above the water level. The water is boiled below the charge and wet steam passes through the plant material. Thus, the plant material is protected from direct heat and contact with the water. One limitation of this method is extended distillation times.

The third type, steam distillation, utilizes steam provided from a separate boiler. The still contains a grid plate under which a steam spreader pipe is fitted. The advantages of this type of "not dry" steam distillation are that it is relatively rapid, therefore charging and emptying the still is much faster and energy consumption is lower. Steam distillation decreases distillation time and improves efficiency of the operation.

Regardless of the type of distilling, the next phase of collecting essential oils from plants involves condensers and separators. Accordingly, the steam containing essential oil vapor is directed out of the top of the still and into a condenser. The conventional art instructs that this extraction of heated steam and oil be by way of a gooseneck with a gauze or screen fitted at the mouth of the gooseneck to prevent plant material being blown over into the condenser.

In the condenser the vapors are cooled, and as they cool, the oils condense out, separating the essential oils from the distillate (a mixture of water and plant essence). The combined oil and hydrosol are then, according to conventional teaching, directed into a Florentine flask, in which they separate into two layers. The essential oil will generally be lighter than water, the oil floats to the surface and the hydrosol drains away.

The conventional teaching instructs that it is important that the oil separators should be large enough in volume to minimize turbulence because significant amounts of oil can be lost with the distillate water caused by turbidity if the oil is not allowed to separate completely. In addition, the temperature of the distillate may have an important bearing on the efficiency of separation of essential oil and water as well as the specific gravity of the essential oil. The optimum temperature for obtaining the best separation can be found by trial and error.

Further, the art instructs that condensers and separators should be constructed of materials that do not react with essential oils or water. Mild steel rusts and is not suitable. Copper has been used successfully for many years, however copper will dissolve in some essential oils and reacts negatively with some components of various essential oils such as Eucalyptus and Geranium, for example. The conventional wisdom instructs that stainless steel is the optimum material for stills, condensers, and separators as it is resistant and durable and readily cleaned. One drawback of stainless steel is its expense and difficulty in forming certain shapes.

Glass containers are often used for smaller amounts of oil but larger quantities are invariably stored in metal drums. Mild steel drums lined with epoxy resin are very popular for essential oils. Plastic containers, e.g. polythene, should not be used because the oil may be absorbed by the plastic resulting in contamination.

SUMMARY OF THE INVENTION

A popular method of obtaining essential oils, particularly for low-volume producers is a low-flow steam distillation process. Plant material, for example, lavender, is placed in a still, high-pressure steam is introduced into the bottom of the still. The steam passes through the plant material heating and saturating it with water. The resulting vapor, a mixture of steam and essential oils, passes out at the top and is conveyed to the condenser. This heated mixture passes through a condenser, typically a long spiral or bundle of tubing, to cool, allowing the heavier water (or more specifically the hydrolat, hydrosol, or floral water) to fall to the bottom of a separator and the essential oil to float on top. The essential oils are then skimmed off the top of the separator. The remaining floral water may also be separately collected for subsequent use.

The present invention, in its various preferred embodiments, replaces the conventional separator as taught in the prior art. A conventional still is used to pass pressurized steam through a selected plant or herbal bio-mass. The resulting heated mixture of water and essential oils is gravity drip-fed into a collector funnel of the present invention. As the mixture is collected in the funnel and passed through an elongated glass tube to an awaiting collection vessel, it cools. The heavier floral water falls to the bottom of the collection vessel and the lighter essential oil floats to the top. The collection vessel includes an elongated, vertically arranged neck that receives the elongated portion of the funnel, but the collection vessel's neck has clearance between the outer wall of the funnel's tube and the inner wall of the neck. The oil escapes the neck by means of a downward directed escape tube having an outlet port on the neck at a first height. The floral water is removed from the bottom of the collection vessel by means of a conduit disposed on a lower portion of the vessel's sidewall.

Advantages of the present invention include a process and apparatus for simple passive separation of light oils (oils that have a density less than that of water). Another advantage of the present invention is the ability to see the separation process because the preferred material for the device is glass. The distiller can also observe when the distillation process is finished. And, the device of the present invention makes the separation process much easier to perform over the devices of the prior and known art.

DRAWING

FIG. 1 is an exploded, front view of a preferred embodiment of the present invention.

DESCRIPTION OF THE INVENTION

Possible embodiments will now be described with reference to the drawings and those skilled in the art will understand that alternative configurations and combinations of components may be substituted without subtracting from the invention. Also, in some figures certain components are omitted to more clearly illustrate the invention.

The preferred embodiment 1 of the present invention (an essencier) replaces both conventional separation devices as taught in the conventional art (such as a Florentine flask). The preferred embodiment includes two components: A funnel 10, and a collection vessel 50. The funnel includes a top funnel 12 (a tapered cylindrical shape with a larger open top 14 narrowing to a smaller open bottom 16 with one continuous sidewall 18 connecting and defining both the open top and open bottom. Extending from the bottom of the funnel, an elongated, narrow, downward directed stem portion 20 is in fluid connection with the funnel. This narrow stem is hollow, with an outside diameter 24 adapted to selectively nest inside a neck portion 52 of the vessel 50 and a terminus that is at second height 22.

The second component, the collection vessel 50, includes a relatively large volume, bulbous body portion 54 adapted to receive a liquid. The bulbous body portion includes a bottom wall 56 and at least one continuous sidewall 58 to define a volume having an open top 60. The open top connects to an elongated neck portion 52 that extends upward and has an inner diameter 62 that is greater than the outer diameter 24 of the funnel stem, yet is sized to support a portion of the funnel sidewall to prevent the funnel from falling into the body portion of the vessel.

The neck portion 52 also includes a port (oil port) 70 for directing the separated essential oil out of the vessel. The port is located on a sidewall of the neck at a first height 64. A oil conduit 72 extends from this port at a slight downward angle and its distal end 74 terminates below the first height 64 and away from the body 54 of the vessel so that a separate collection device (not shown and as would be understood in the conventional art) may rest adjacent to the vessel for collection of the essential oil distilled using the present invention.

The vessel 50 also includes a hydrosol port 80 located near the bottom wall of the vessel body on the sidewall. The hydrosol port is in fluid communication with conduit 82 (preferably an S-shaped conduit, however other shapes and configurations would work equally well provided the arrangement of ports and openings conforms to the principles herein) that extends upwards from the port 80 and away from the vessel body 54. Near a top portion of the S-shaped conduit 82 at a height that is lower than the first height 64 (oil port), the S-shaped conduit includes a vent 84 with a vertically extending chimney 86.

The distal end 88 of the chimney terminates above the first height 64 (oil port) and is adapted to provide atmospheric pressure equalization for the vessel as hydrosol flows out of the vessel body. The S-shaped conduit 80 terminates in a downward extending tube portion 90 that is directed away from the body and at a height that is lower than the oil port 64 (first height) but higher than the open bottom of the funnel stem 22 (second height).

In this preferred embodiment all of the components are made from glass, such as industry standard glass used in the fabrication of most laboratory instruments.

A preferred method for distilling and collecting essential oils using the device of the present invention includes the following steps:

Using a conventional steam-generating process whereby distilling essential oils from a desired plant material using a still whereby high-pressure steam is introduced into the bottom of the still and the steam passes through the plant material heating and saturating it with water resulting in a vapor mixture of steam and essential oils that then passes out at the top of the still and is conveyed to a condenser where the vapor becomes a condensed distillate;

Then, providing a funnel and a collection vessel whereby the funnel comprises a top funnel having an open top and a smaller open bottom coupled to a downward extend stem portion, the funnel is configured to selectively insert into the collection vessel;

the collection vessel comprises a bulbous body portion configured and adapted to receive a liquid, the bulbous body portion includes a bottom wall and at least one continuous sidewall configured to define a volume having an open top, an elongated neck portion coupled to the open top, the elongated neck portion extends upward and is configured to selectively receive the stem portion of the funnel, the neck portion further comprises an oil port configured to direct separated essential oil out of the collection vessel, the oil port arranges on the neck portion at a first height 64, an oil conduit extends from the oil port at a slight downward angle and its distal end terminates below the first height;

And then, using gravity and a siphoning affect, directing the distillate to drip feed into the funnel; allowing the distillate to cool whereby an essential oil floats to the top and the heavier hydrosol to the bottom of the vessel; selectively removing the essential oil and/or the hydrosol from collection vessel, the hydrosol is removed by means of the conduit disposed on a lower portion of the vessel's sidewall and the essential oil from the oil port.

This method further contemplates using glass components for the vessel and funnel whereby a user can view a level of the essential oil in the vessel.

Although the invention has been particularly shown and described with reference to certain embodiments, it will be understood by those skilled in the art that various changes in form and detail may be made without departing from the spirit and scope of the invention. And, although claims are not required, I claim at least:

I claim:

1. A device comprising:

a funnel; and a collection vessel;

the funnel comprises a top funnel having an open top and a smaller open bottom coupled to a downward extend stem portion, the funnel is configured to selectively insert into the collection vessel;

the collection vessel comprises a bulbous body portion configured and adapted to receive a liquid, the bulbous body portion includes a bottom wall and at least one continuous sidewall configured to define a volume having an open top, an elongated neck portion coupled to the open top, the elongated neck portion extends upward and is configured to selectively receive the stem portion of the funnel, the neck portion further comprises an oil port configured to direct separated essential oil out of the collection vessel, the oil port arranges on the neck portion at a first height, an oil conduit extends from the oil port at a slight downward angle and its distal end terminates below the first height; and a hydrosol port arranged and configured near the bottom wall of the vessel body sidewall, the hydrosol port is in fluid communication with a conduit, the conduit extends upwards from the hydrosol port and away from the vessel body, the conduit further comprises a vent in fluid communication with the conduit, the vent arranges near a top portion of the conduit at a vent-height that is lower than the first height, the vent further comprises a vertically extending chimney, a distal end of the chimney terminates above the first height and is configured and adapted to provide atmospheric pressure equalization for the vessel;

the conduit further comprises a terminus that terminates in a downward extending tube portion that is directed away from the collection vessel body and at a height that is lower than the first height but higher than the second height.

2. The device of claim 1 wherein the funnel further comprises:

a tapered cylindrical shape with a larger open top narrowing to a smaller open bottom with one continuous sidewall connecting and defining both the open top and open bottom;

extending from the bottom of the funnel, an elongated, narrow, downward directed stem portion is in fluid connection with the funnel, the narrow stem is hollow with an outside diameter adapted to selectively nest inside the neck portion of the vessel and a terminus that is at second height.

3. The device of claim 1 wherein:

the funnel and the collection vessel comprise glass.

4. A method of distilling essential oils from a desired plant material using a still whereby high-pressure steam is introduced into the bottom of the still and the steam passes through the plant material heating and saturating it with water resulting in a vapor mixture of steam and essential oils that then passes out at the top of the still and is conveyed to a condenser where the vapor becomes a distillate, the method comprising:

providing a funnel and a collection vessel;

the funnel comprises a to funnel having an open top and a smaller open bottom coupled to a downward extend stem portion, the funnel is configured to selectively insert into the collection vessel;

the collection vessel comprises a bulbous body portion configured and adapted to receive a liquid, the bulbous body portion includes a bottom wall and at least one continuous sidewall configured to define a volume having an open top, an elongated neck portion coupled to the open top, the elongated neck portion extends upward and is configured to selectively receive the stem portion of the funnel, the neck portion further comprises an oil port configured to direct separated essential oil out of the collection vessel, the oil port arranges on the neck portion at a first height 64, an oil conduit extends from the oil port at a slight downward angle and its distal end terminates below the first height: and a hydrosol port arranged and configured near the bottom wall of the vessel body sidewall, the hydrosol port is in fluid communication with a conduit, the conduit extends upwards from the hydrosol port and away from the vessel body, the conduit further comprises a vent in fluid communication with the conduit, the vent arranges near a to portion of the conduit at a vent-height that is lower than the first height, the vent further comprises a vertically extending chimney, a distal end of the chimney terminates above the first height and is configured and adapted to provide atmospheric pressure equalization for the vessel;

the conduit further comprises a terminus that terminates in a downward extending tube portion that is directed away from the collection vessel body and at a height that is lower than the first height but higher than the second height;

using gravity, directing the distillate to drip feed into the funnel;

allowing the distillate to cool whereby an essential oil floats to the to and a hydrosol to the bottom of the vessel;

removing the hydrosols from the collection vessel by means of the conduit disposed on a lower portion of the vessel's sidewall.

5. The method of claim 4 further comprising:

viewing a level of the essential oil in the vessel.

6. A separating device for distilling essential oils, the device comprises:

collector funnel having a downwardly directed stem portion having an outside diameter; and a collection vessel whereby the stem portion adapts to insert in an upward extending neck portion of the collection vessel, the neck portion includes an inner diameter that is greater than the outer diameter of the funnel stem and oil port disposed on the neck at a first height;

the vessel further comprises a body having a hydrosol port at a lower portion of a body sidewall, the hydrosol port being in fluid communication with an evacuation tube having a proximal end and an S-shape, the conduit further comprises an air vent at a top portion of the evacuation tube, the air vent connected to the evacuation tube at an air vent proximal end positioned at a second height lower than the first height, the air vent extends upward to a distal end positioned at a height higher than the first height.

* * * * *